US009981366B2

(12) United States Patent
Todd et al.

(10) Patent No.: US 9,981,366 B2
(45) Date of Patent: May 29, 2018

(54) CLEANABLE REVERSIBLE SOCKET AND DRIVER

(71) Applicant: Malco Products, Inc., Annandale, MN (US)

(72) Inventors: Greg Thomas Todd, Clear Lake, MN (US); Dennis Glenn Geurts, Paynesville, MN (US); Lucas Daniel Runke, Hutchinson, MN (US)

(73) Assignee: Malco Products, Inc., Annandale, MN (US)

( * ) Notice: Subject to any disclaimer, the term of this patent is extended or adjusted under 35 U.S.C. 154(b) by 336 days.

(21) Appl. No.: 15/067,776

(22) Filed: Mar. 11, 2016

(65) Prior Publication Data

US 2017/0239790 A1 Aug. 24, 2017

Related U.S. Application Data

(60) Provisional application No. 62/298,196, filed on Feb. 22, 2016.

(51) Int. Cl.
*B25B 13/06* (2006.01)
*B25B 23/00* (2006.01)
*B25B 23/12* (2006.01)

(52) U.S. Cl.
CPC ..... *B25B 23/12* (2013.01); *B25B 13/06* (2013.01); *B25B 23/0035* (2013.01)

(58) Field of Classification Search
CPC ..... B25B 13/06; B25B 13/065; B25B 23/12; B25B 23/0021; B25B 23/0035
See application file for complete search history.

(56) References Cited

U.S. PATENT DOCUMENTS 2,718,806 A * 9/1955 Clark ..... B25B 23/12 403/DIG. 1
2,750,828 A * 6/1956 Wendling ..... B25B 13/06 279/128
3,227,015 A * 1/1966 Tremblay ..... B25B 13/06 16/429
3,832,916 A * 9/1974 Schoeps ..... B25B 23/0021 81/464

(Continued)

OTHER PUBLICATIONS

TOOLGUYD, "Gearwrench Magnetic Extension Review," http://toolguyd.com/gearwrench-magnetic-extension-review/, 2016, 4 pages.

*Primary Examiner* — David B Thomas
(74) *Attorney, Agent, or Firm* — Briggs and Morgan, P.A.; Gerald E. Helget

(57) ABSTRACT

A cleanable reversible socket and driver for a hex head fastener having a driver shank with a hex shaped shaft having a tool mounting end and a socket mounting end and a collar therebetween. A cleanable reversible socket is provided having a hex passage therethrough rotationally lockable with the driver shank hex shaped shaft, The socket is removably, nonrotatably mountable onto the driver shank shaft at the socket mounting end up to the collar having two different sized hex socket ends. A magnet on the socket mounting end of the driver shank is to be located at a bottom of one of the two hex socket ends when the socket is mounted on the driver shank to hold the hex head fastener in one of the socket ends.

23 Claims, 1 Drawing Sheet

(56) References Cited

U.S. PATENT DOCUMENTS

| | | | | |
|---|---|---|---|---|
| 5,148,724 | A * | 9/1992 | Rexford | B25B 13/06 81/124.4 |
| 5,485,769 | A * | 1/1996 | Olson | B25B 15/001 81/177.85 |
| 6,418,821 | B1 * | 7/2002 | Yamakawa | B25B 13/06 81/437 |
| 8,196,495 | B2 * | 6/2012 | Chen | B25B 13/06 81/125 |
| 8,695,461 | B2 * | 4/2014 | Moss | B25B 13/06 81/125 |
| 9,272,395 | B2 * | 3/2016 | Hui | B25B 13/065 |
| 9,463,558 | B2 * | 10/2016 | Yang | B25B 23/0035 |
| 9,694,480 | B2 * | 7/2017 | Brown | B25B 23/12 |
| 2008/0041193 | A1 * | 2/2008 | Baker | B25B 13/06 81/124.6 |
| 2014/0013905 | A1 * | 1/2014 | Li | B25B 13/06 81/124.4 |
| 2014/0174263 | A1 * | 6/2014 | Moss | B25B 13/06 81/125 |
| 2015/0143965 | A1 * | 5/2015 | Yang | B25B 15/008 81/437 |
| 2016/0263732 | A1 * | 9/2016 | Lourenco | B25B 23/0035 |

* cited by examiner

CLEANABLE REVERSIBLE SOCKET AND DRIVER

BACKGROUND OF THE INVENTION

The present invention relates to hand tools for driving fasteners or hex head screws into work pieces, and more particularly, to a cleanable reversible socket and driver tool combination.

Hex head screws may be self-tapping and are commonly used in sheet metal, and metal and plastic part assemblies to secure pieces together. Often many screws are used at one time. Socket drivers have traditionally been used to drive the screws into the work piece. Socket drivers may be of a one piece construction requiring multiple drivers when different sized hex head screws are used. Ratchet drivers have also been used to drive hex head screws into work pieces. Sockets mounted on shanks that can be fastened into a chuck of a handle held, battery operated drill are also commonly used. Hex head bolts are also commonly used with threaded holes, nuts and/or self-locking nuts in assembly work and also require some form socket driver.

Because it is common to drive many hex screws in one operation, speeding up the assembly process has been desirable. Magnets have placed into the sockets or the driver/socket combination has been magnetized to hold the screws in the socket. The operator simply places a hex head screw into the socket and the magnetism holds the screw in place just prior to and during driving of the screw into the work piece. Expectedly, screw shavings and metal waste are commonly associated with the driving process, especially with shelf-tapping screws. The magnet or magnetized socket literally sucks up and holds the shavings till the socket eventually become plugged and the hex head will not properly fit into the socket requiring that the screwing operation be stopped and the socket must be suitably cleaned such as with an air compressor to blow the shavings and metal debris out of and away from the socket cavity.

There is a need for a cleanable reversible socket and driver tool that permits easy cleaning of the socket of metal debris and that the socket is reversible to permit presentation of another sized socket without actually changing of the currently used socket.

SUMMARY OF THE INVENTION

A cleanable reversible socket and driver for a hex head fastener having a driver shank with a hex shaped shaft having a tool mounting end and a socket mounting end and a collar therebetween. A cleanable reversible socket is provided having a hex passage therethrough rotationally lockable with the driver shank hex shaped shaft, The socket is removably, nonrotatably mountable onto the driver shank shaft at the socket mounting end up to the collar having two different sized hex socket ends. A magnet on the socket mounting end of the driver shank is to be located at a bottom of one of the two hex socket ends when the socket is mounted on the driver shank to hold the hex head fastener in one of the socket ends.

A principal object and advantage to the present invention is that the socket is reversible for use with one of two sizes with the need to replace the socket.

Another object and advantage to the present invention is that the socket is readily removable from the driver shank with magnet for easy pass through unclogging and cleaning while the magnet end of the driver shank is simply brushed off and then the socket and driver are reassembled.

Another object and advantage to the present invention is that the socket is releasably interlockable onto the driver shaft.

Another object and advantage to the present invention is that the drive end of the drive shank is magnetized or has a magnet to hold a hex screw or fastener for easy positioning on the work piece to be fastened.

Another object and advantage to the present invention is that the driver shank will work with a handle of a driver tool that receives shanks and hold them in place for driving operation, a ratchet or a chuck of a hand held battery operated drill.

Another object and advantage to the present invention is that the driver shank may be of variable lengths depending on the particular operation of driving fasteners.

Another object and advantage to the present invention is that a biased detent or spring loaded retaining ball is located near the socket mounting end on the driver shank and a cooperating groove is located in the inside passage of the socket to releasably positionally lock the socket onto the drive shank.

DETAILED SPECIFICATION

Figure 1:
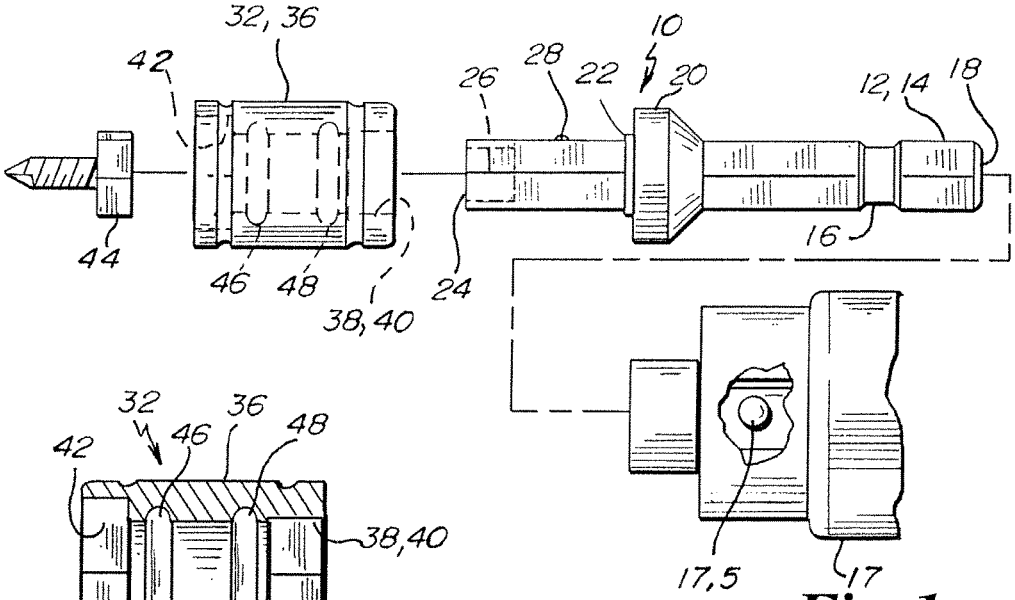
FIG. 1 is an exploded elevational view of the cleanable reversible socket and driver invention assembly including a fastener and a hand tool, partially broken away.
Figure 3:
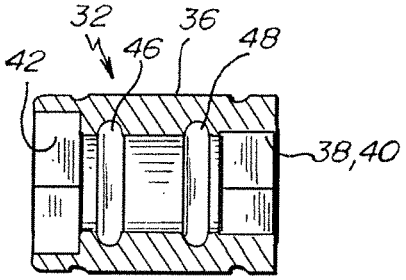
FIG. 3 is a vertical cross sectional view of the cleanable reversible socket.
Figure 2:
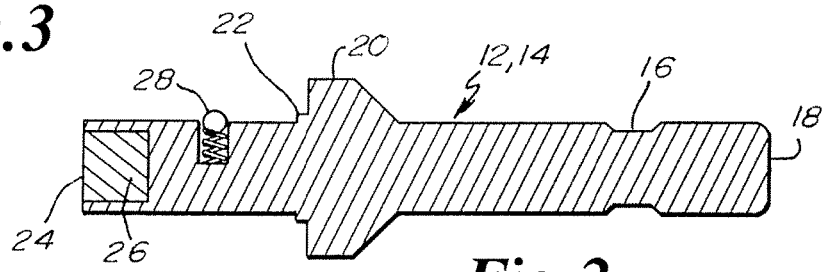
FIG. 2 is a vertical cross sectional view of the drive shank.

Referring to FIGS. 1 through 3, the cleanable reversible socket and driver 10 for a hand tool may be seen and appreciated. The socket and driver 10 includes a drive shank 12 that will fit on to a multipurpose driver handle 17 with spring loaded retaining balls. The drive shank 12 will also removably receive and hold a socket or drive sleeve 32.

More particularly, the drive shank 12 may be of various lengths depending on it particular use. The shank 12 has a hex shaped shaft 14 and at the tool mounting end 18 is located an intermediate annular channel 16 that may be gripped and held by the spring loaded retaining balls 17.5 of the driver handle 17. Intermediate of the hex shaft 14 or drive shank 12 is an annular collar 20. Forward of and adjacent to the collar 20 is raised stop ring 22, both of which will be appreciated later. Adjacent to the socket drive end 24 is located spring loaded retaining ball or detent 28. At the drive end 24 is imbedded magnet 26.

The cleanable removable socket or drive sleeve 32 has a round exterior 36 and an internal through passage 38 which is hex shaped to engageably match the hex shaped drive shank 12 and shaft 14. By this arrangement, the tool handle 17 may transmit rotational torque to the shaft 14, shank 12 and ultimately to the socket or drive sleeve 32 for turning in an hex screw or fastener 44 into a work piece.

The socket 32 has first and second internal hex ends 40, 42. The smaller hex end 40 is of equal size or larger than the hex size of the hex shaped shaft 14 and the socket drive end 24. The larger hex end 42 is of a larger size than the hex size of the hex shaped shaft 14 and the socket drive end 24. The hex sizes of the shaft and hex ends may vary, such as, from ¼, ⅜, 7/16 or 5/16 inch. Within internal passage 38 are located first and second internal grooves or channels 46, 48 for axial locking of the spring loaded retaining ball or detent 28 on shank 12 depending on which side, first or second socket ends 40, 42 are to be used.

Figure 4:
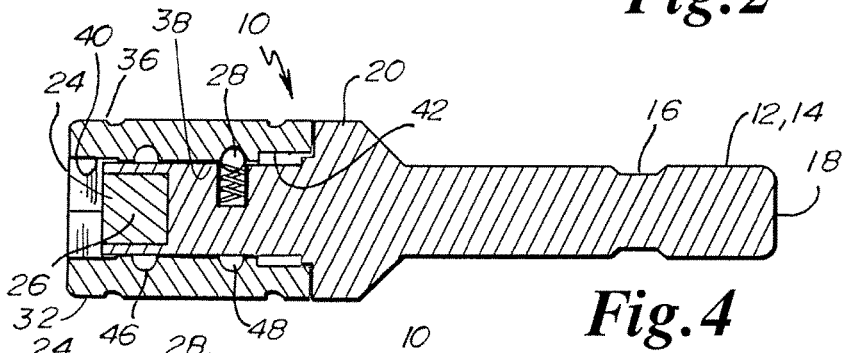
FIG. 4 is a vertical cross sectional view of the assembled cleanable reversible socket and driver invention.
Figure 5:
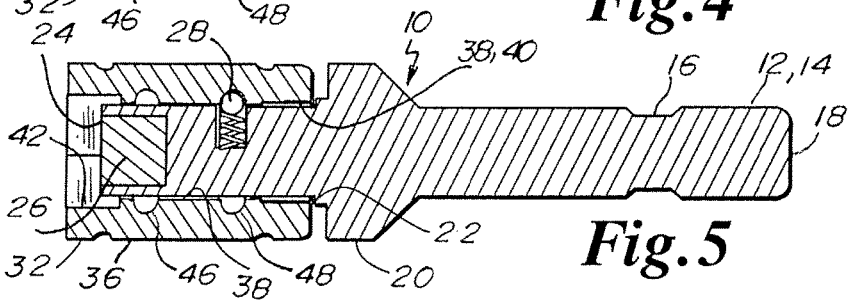
FIG. 5 is a vertical cross sectional view of the assembled cleanable reversible socket and driver invention with the socket reversed from its position shown in FIG. 4.

The assembly and operation of the cleanable reversible socket and driver 10 with hand tool 17 may now be appreciated and understood, particularly in FIGS. 1, 4 and 5. The drive shank 12 is grasped and the tool mounting end is fed into the receptacle end of the hand tool 17 until the annular channel 16 snaps into engagement with the spring loaded retaining balls 17.5 Next the desired size of socket 32, such as internal hex end ⅜ inch 42, is selected. The opposite hex end 40 (¼ inch) is feed onto hex shaped shaft 14 until the spring loaded retaining ball or detent 28 on shaft 14 is engaged with second internal groove or channel 48 which will axially lock the socket 32 onto the shaft 14 as the outer surface of hex end 40 (¼ inch) will abut against the raised stop collar 22. The handle 17 may be replace with the tightening chuck of a drill or a ratchet tool.

Now the cleanable reversible socket and driver 10 may be used by an operator. The ⅜ inch hex head of a hex screw 44 or bolt or other fastener is lined up with the ⅜ inch hex end 42 of the socket 32. The magnet 26 at the base of hex end 42 will suck up and draw in the ⅜ inch hex head of the fastener 44 and hold it thereat. The operator simply point the fastener 44 into the work piece and transmits the rotation torque to secure the fastener into the work piece. After many, many uses of the ⅜ inch hex end 42, the socket hex end 42 becomes clogged with filings, shavings and metal particles to the point where the fastener has difficulty in fitting into the ⅜ inch hex end 42.

When the hex end 42 becomes clogged, the operator may simply pull the socket 32 off the hex shaped shaft 14 by overcoming the grip of the detent 28 in groove 48. Because the socket is not magnetized, the debris may simply be blown out of the socket 32 through internal passage 38 or tapping the socket 32 on a hard surface. The magnet end 24 of the shaft may simply be wiped off with a rag to remove the particles.

Thereafter the socket 32 may be reassembled onto the shaft 14 or reversed to present the ¼ inch socket hex end 40 for use by the operator. Other socket 32 sizes may be contemplated for use. all that is necessary is that the hex shaped shaft 14 of the drive shank 12 be of a size compatible with the hex shaped internal passage 38 or the socket 32 to guarantee compatible rotational torque being transmitted through the parts.

The above description and FIGS. are for illustrative purposes only. The true scope of this invention is defined by the following claims.

What is claimed:

1. A cleanable reversible socket and driver for a hex head fastener, comprising:

(a) a driver shank with a hex shaped shaft having a tool mounting end and a socket mounting end and a collar therebetween; and (b) a cleanable reversible socket having a hex passage therethrough rotationally lockable with the driver shank hex shaped shaft, the socket being removably, nonrotatably mountable onto the driver shank shaft at the socket mounting end up to the collar having two different sized hex socket ends.

2. The socket and driver of claim 1, further comprising a tool with a handle securable to the mounting end of the driver shank to impart rotational force to the shank and socket.

3. The socket and driver of claim 1, further comprising a magnet on the socket mounting end of the driver shank to be located at a bottom of one of the two hex sockets when the socket is mounted on the driver shank.

4. The socket and driver of claim 1, further comprising a biased detent near the socket mounting end of the driver shank and a cooperating groove in the inside passage of the socket to releasably positionally lock the socket onto the drive shank.

5. The socket and driver of claim 1, further comprising a second groove in the inside passage of the socket to releasably positionally lock the socket when reversed onto the drive shank.

6. The socket and driver of claim 1 wherein one of the two different sized hex socket ends and the passage are of equal sizes and the other of the two different sized hex socket ends is larger than the size of the hex passage.

7. A cleanable reversible socket and driver for a hex head fastener, comprising:

(a) a driver shank with a hex shaped shaft having a tool mounting end and a socket mounting end and a collar therebetween;

(b) a cleanable reversible socket having a hex passage therethrough rotationally lockable with the driver shank hex shaped shaft, the socket being removably, nonrotatably mountable onto the driver shank shaft at the socket mounting end up to the collar having two different sized hex socket ends; and (c) a magnet on the socket mounting end of the driver shank to be located at a bottom of one of the two hex sockets when the socket is mounted on the driver shank to hold the hex head fastener in one of the socket ends.

8. The socket and driver of claim 7, further comprising a tool with a handle securable to the mounting end of the driver shank to impart rotational force to the shank and socket.

9. The socket and driver of claim 7, further comprising a biased detent near the socket mounting end of the driver shank and a cooperating groove in the inside passage of the socket to releasably positionally lock the socket onto the drive shank.

10. The socket and driver of claim 7, further comprising a second groove in the inside passage of the socket to releasably positionally lock the socket when reversed onto the drive shank.

11. The socket and driver of claim 7 wherein one of the two different sized hex socket ends and the passage are of equal sizes and the other of the two different sized hex socket ends is larger than the size of the hex passage.

12. A cleanable reversible socket and driver for a hex head fastener, comprising:

(a) a driver shank with a hex shaped shaft having a tool mounting end and a socket mounting end and a collar therebetween;

(b) a cleanable reversible socket having a hex passage therethrough rotationally lockable with the driver shank hex shaped shaft, the socket being removably, nonrotatably mountable onto the driver shank shaft at the socket mounting end up to the collar having two different sized hex socket ends;

(c) a magnet on the socket mounting end of the driver shank to be located at a bottom of one of the two hex sockets when the socket is mounted on the driver shank to hold the hex head fastener in one of the socket ends; and (d) a biased detent near the socket mounting end of the driver shank and a cooperating groove in the inside passage of the socket to releasably positionally lock the socket onto the drive shank.

13. The socket and driver of claim 12, further comprising a biased detent near the socket mounting end of the driver shank and a cooperating groove in the inside passage of the socket to releasably positionally lock the socket onto the drive shank.

14. The socket and driver of claim 12, further comprising a tool with a handle securable to the mounting end of the driver shank to impart rotational force to the shank and socket.

15. The socket and driver of claim 12, further comprising a second groove in the inside passage of the socket to releasably positionally lock the socket when reversed onto the drive shank.

16. The socket and driver of claim 12 wherein one of the two different sized hex socket ends and the passage are of equal sizes and the other of the two different sized hex socket ends is larger than the size of the hex passage.

17. A cleanable reversible socket and driver for a hex head fastener, comprising:

(a) a driver shank with a hex shaped shaft having a tool mounting end and a socket mounting end and a collar therebetween;

(b) a cleanable reversible socket having a hex passage therethrough rotationally lockable with the driver shank hex shaped shaft, the socket being removably, nonrotatably mountable onto the driver shank shaft at the socket mounting end up to the collar having two different sized hex socket ends;

(c) a magnet on the socket mounting end of the driver shank to be located at a bottom of one of the two hex sockets when the socket is mounted on the driver shank to hold the hex head fastener in one of the socket ends;

(d) a biased detent near the socket mounting end of the driver shank and a cooperating groove in the inside passage of the socket to releasably positionally lock the socket onto the drive shank; and (e) a second groove in the inside passage of the socket to releasably positionally lock the socket when reversed onto the drive shank.

18. The socket and driver of claim 17 wherein one of the two different sized hex socket ends and the passage are of equal sizes and the other of the two different sized hex socket ends is larger than the size of the hex passage.

19. A cleanable reversible socket and driver for a hex head fastener, comprising:

(a) a driver shank with a shaft having a tool mounting end and a shaped socket mounting end and a collar therebetween; and (b) a cleanable reversible socket having a passage therethrough having a shape of the shaft shaped socket mounting end as to be rotationally lockable with the driver shank shaped shaft, the socket being removably, nonrotatably mountable onto the driver shank shaft at the socket mounting end up to the collar having two different sized hex socket ends.

20. The socket and driver of claim 19, further comprising a tool with a handle securable to the mounting end of the driver shank to impart rotational force to the shank and socket.

21. The socket and driver of claim 19, further comprising a magnet on the socket mounting end of the driver shank to be located at a bottom of one of the two hex sockets when the socket is mounted on the driver shank.

22. The socket and driver of claim 19, further comprising a biased detent near the socket mounting end of the driver shank and a cooperating groove in the inside passage of the socket to releasably positionally lock the socket onto the drive shank.

23. The socket and driver of claim 19, further comprising a second groove in the inside passage of the socket to releasably positionally lock the socket when reversed onto the drive shank.

* * * * *